United States Patent [19]

Quisenberry

[11] 3,974,061

[45] Aug. 10, 1976

[54] ISOMERIZATION OF $C_5$ AND $C_6$ ISOMERIZABLE HYDROCARBONS

[75] Inventor: Robert E. Quisenberry, Port Arthur, Tex.

[73] Assignee: Texaco Inc., New York, N.Y.

[22] Filed: Dec. 16, 1974

[21] Appl. No.: 533,058

[52] U.S. Cl. ..... 208/65; 260/683.67; 260/683.68

[51] Int. Cl.[2] ..... C10G 39/00

[58] Field of Search ..... 208/65; 260/683.68, 260/683.67

[56] References Cited

UNITED STATES PATENTS

| | | | |
|---|---|---|---|
| 3,164,642 | 1/1965 | Stringer et al. | 260/683.68 |
| 3,541,181 | 11/1970 | Bercik et al. | 260/683.68 |
| 3,791,960 | 2/1974 | Davies et al. | 260/683.68 |

*Primary Examiner*—Herbert Levine
*Attorney, Agent, or Firm*—T. H. Whaley; C. G. Ries; George J. Darsa

[57] ABSTRACT

An improved vapor phase catalytic isomerization of a hydrocarbon fraction containing $C_5$ and $C_6$ isomerizable hydrocarbons is obtained by subjecting the hydrocarbon fraction in the presence of gaseous hydrogen to a plural stage, such as a dual stage, catalytic isomerization operation preferably employing a chlorinated platinum-containing alumina catalyst wherein the hydrocarbon fraction undergoing isomerization is supplied sequentially and serially from the first stage through to the last stage of the plural stage isomerization operation and wherein the first stage of the plural stage isomerization operation is supplied with the hydrocarbon fraction at a temperature in the range about 300°–305°F. and recovered from the first stage at a temperature in the range about 310°–335°F. The last stage of the plural stage isomerization operation is supplied with the hydrocarbon fraction at a temperature in the range about 315°–350°F. and recovered from the last stage at a temperature in the range about 340°–370°F. In the plural stage isomerization operation the catalyst employed in the first stage is active and fresh whereas the catalyst employed in the last stage is relatively inactive or depleted.

17 Claims, No Drawings

ISOMERIZATION OF $C_5$ AND $C_6$ ISOMERIZABLE HYDROCARBONS

This invention relates to the upgrading of hydrocarbon streams containing isomerizable hydrocarbons. More particularly this invention relates to the vapor phase catalytic isomerization of hydrocarbon streams or fractions, particularly petroleum hydrocarbon fractions containing $C_5$ and $C_6$ isomerizable hydrocarbons, such as might be obtained from a light straight run gasoline or naphtha fraction by hydrotreating, or other comparable naphtha or gasoline fractions containing substantial amounts, major or minor, total, of $C_5$ and $C_6$ isomerizable hydrocarbons, e.g. n-pentane and n-hexane.

It is known to treat hydrocarbon fractions containing isomerizable $C_5$ and $C_6$ hydrocarbons to isomerize the n-pentane and n-hexane components thereof so as to improve or increase the octane number or rating of such fractions. One scheme proposed heretofore has been to separate the isomerizable $C_5$ and $C_6$ hydrocarbons and then to subject such hydrocarbons separately to isomerization. A suitable such scheme is set forth in U.S. Pat. No. 3,718,710. The disclosures of this patent are herein incorporated and made part of this disclosure, particularly with respect to the various pretreatment operations involving hydrotreatment, molecular sieve fractionation for the removal of contaminants, fractionation steps and sequences, the isomerization operation and particularly the isomerization catalyst. In U.S. Pat. No. 3,718,710 the hexane component to be isomerized is subjected to vapor phase isomerization, specifically hydroisomerization, by contact with an isomerization catalyst consisting essentially of chlorided platinum-alumina composite activated and stabilized as described in U.S. Pat. Nos. 3,242,228 and 3,551,516. The disclosures of these patents describing the isomerization catalyst and its activation and stabilization are herein incorporated and made part of this disclosure.

The operations suggested or proposed heretofore in connection with the isomerization of $C_5$ and $C_6$ isomerizable hydrocarbons have not for the most part been completely satisfactory. As indicated in U.S. Pat. No. 3,718,710 separate isomerization operations for the $C_5$ and $C_6$ isomerizable hydrocarbons have been proposed. Such an arrangement necessitates duplication of many of the processing units, particularly fractionators and isomerization units.

It is an object of this invention to provide an improved isomerization process for the isomerization of hydrocarbon fractions containing $C_5$ and $C_6$ isomerizable hydrocarbons, particularly n-pentane and n-hexane which may be present in a major or minor amount by weight, total, of the hydrocarbon fraction undergoing isomerization.

It is another object of this invention to provide a process for the isomerization of a hydrocarbon fraction containing $C_5$ and $C_6$ isomerizable hydrocarbons such that the resulting isomerized product or isomerate exhibits an improved or increased octane number or rating.

It is another object of this invention to provide an isomerization operation involving the isomerization of $C_5$ and $C_6$ isomerizable hydrocarbons so as to maximize conversion of the cyclohexane in the hydrocarbon fraction undergoing isomerization to methylcyclopentane.

Still another object of this invention is to provide an improved process for the hydroisomerization of $C_5$ and $C_6$ isomerizable hydrocarbons employing a chlorided platinum-alumina composite catalyst.

How these and other objects of this invention are achieved will become apparent in the light of the accompanying disclosure. In at least one embodiment of the practices of this invention at least one of the foregoing objects will be achieved.

In accordance with this invention an improved process for the isomerization of $C_5$ and $C_6$ hydrocarbons is obtained by subjecting the $C_5$ and $C_6$ hydrocarbons to a plural stage vapor phase catalytic isomerization operation wherein the hydrocarbons undergoing isomerization are supplied sequentially and serially from the first stage of the plural stage isomerization operation to the last stage and wherein the first stage of the plural stage isomerization operation is supplied with the hydrocarbons to be isomerized at a temperature in the range about 300°–305°F. with recovery of the resulting isomerized hydrocarbons from the first stage being at a temperature in the range about 310°–335°F. In the plural stage isomerization operation the last stage is supplied with the hydrocarbons undergoing isomerization at a temperature in the range about 315°–350°F. with the recovery of the resulting isomerized hydrocarbons from the last stage being at a temperature in the range about 340°–370°F.

Preferably, the plural stage isomerization operation is a dual stage or two-stage isomerization operation employing in series a first stage isomerizer followed by a second stage isomerizer. There is usefully employed an extra isomerization unit in combination with the plural stage or dual stage isomerization operation wherein the extra isomerizer would contain an isomerization catalyst undergoing regeneration or reactivation such that upon completion of the regeneration or reactivation of the catalyst therein and upon depletion or deactivation of the catalyst in the last or second stage of the plural stage or dual stage isomerization operation, respectively, the fresh, reactivated catalyst in the extra stage can be employed as the first stage with the replaced first stage becoming the second stage and so forth and the replaced second or last stage then subjected to treatment for catalyst regeneration or reactivation.

In the plural stage catalytic isomerization operation in accordance with this invention the isomerization operation in each of the stages is carried out in the presence of gaseous hydrogen, i.e. hydroisomerization is carried out in each of the stages making up the plural stage isomerization operation. Desirably, the molar ratio of hydrogen to hydrocarbon in each of the isomerization stages is about 1.25. Also, desirably, in each of the isomerization units making up the plural stage isomerization operation the hydrocarbons are supplied thereto at a liquid hourly space velocity of about 2.0 $V_o/Hr/V_c$. Also, desirably, each of the isomerization operations is carried out at substantially the same pressure with the overall plural stage isomerization being carried out substantially isobarically, i.e. each isomerization unit being operated at a pressure in the range 450–550 psig, preferably about 500 psig, and each isomerization unit being operated at substantially the same pressure. Desirably, also, each of the isomerization units is operated adiabatically, i.e. without the addition of extraneous heat thereto other than that supplied by the reactants, i.e. the gaseous hydrogen and hydrocarbon feed being supplied to the isomerization unit and the resulting heat of reaction due to the isomerization and related reactions taking place.

In the practices of this invention it is preferred to employ a chlorinated platinum or aluminum composite catalyst, such as an in-situ chlorinated platinum-eta-alumina catalyst having a platinum content of about 0.6% by weight, more or less.

The plural stage isomerization operations desirably employ the same isomerization catalyst in each of the isomerization units making up the plural stage isomerization operation. The isomerization unit, however, does not employ catalysts which have the same relative activity despite the fact that the same catalyst is preferably employed. By way of explanation, in the plural stage isomerization operation in accordance with this invention the catalyst making up the first stage is more active than the catalyst making up the last stage. For example, the catalyst employed in the first stage of the isomerization operation would be a fresh catalyst which has been employed for a relatively short time, such as up to about 2000 hours, more or less, such as in the range 1200–2400 hours, on stream in connection with the isomerization of the $C_5$–$C_6$ hydrocarbon fraction supplied thereto. Under such conditions the activity of the isomerization catalyst would still be at a fairly high level and would be considered in the practice of this invention to be a "fresh" catalyst.

On the other hand, the catalyst making up the last stage of the plural stage isomerization operation would be a relatively inactive catalyst, i.e. a catalyst which has a relatively depleted activity or which would be considered substantially less active as compared with the catalyst employed in the first stage. The catalyst employed in the last stage of the isomerization unit would have been on-line or in service for a total of at least about 4500 hours, including its service time as a first stage catalyst or prior service before service as the last stage catalyst, such as having been in service as an isomerization catalyst for the isomerization of $C_5$ and $C_6$ hydrocarbons in accordance with this invention for a period of time in the range from about 4000 to about 5500 hours, more or less. The last stage catalyst would be maintained in service until the activity of the catalyst shall have been substantially depleted to the extent that beneficial results in accordance with this invention would no longer be obtainable therefrom or its use as an isomerization catalyst under the conditions set forth herein would no longer be justified.

When the catalyst of the last stage has had its activity substantially reduced, this catalyst would be taken out of service and another stage substituted as the last stage of the isomerization operation as described hereinabove. Since the first stage of the isomerization operation employs an active catalyst the temperature of the hydrocarbon feed to the first stage is relatively low, such as in the range 300°–305°F. On the other hand, however, since the activity of the catalyst making up the last stage of the isomerization is low or is substantially depleted the temperature of the hydrocarbon feed to the last stage would be substantially higher, such as a temperature in the range 315°–350°F. or in the range about 10°–50°F. higher than the temperature of the hydrocarbons supplied to the first stage. Further, as indicated hereinabove, because the isomerization and other reactions taking place within each of the isomerization units are overall exothermic, the temperature of the hydrocarbons leaving the first stage would be in the range 310°–335°F., about 5°–35°F. higher than the feed thereto and the temperature of the hydrocarbons leaving the last stage would be in the range about 340°–370°F., about 10°–55°F. higher than the feed thereto with a resulting temperature differential between the temperature of the hydrocarbon fraction recovered from the first stage and the temperature of the hydrocarbon fraction recovered from the last stabe being in the range about 5°–60°F.

Various hydrocarbon fractions, particularly petroleum hydrocarbon fractions derivable from light straight run gasolines or naphtha containing a substantial amount of isomerizable $C_5$ and $C_6$ hydrocarbons, either a major or minor amount, total, are usefully employed in the plural stage isomerization operation in accordance with this invention. It is preferred to employ a $C_5$–$C_6$ cut from a light straight run gasoline, such as a $C_5$–$C_6$ cut having a boiling point range in the range from about 80°–90°F. to about 210°–225°F., more or less, e.g. an IBP in the range 85°–115°F. to an EP in the range 175°–215°F. It is preferred in the practice of this invention to employ a hydrotreated $C_5$–$C_6$ isomerizable hydrocarbon-containing petroleum fraction in the plural stage isomerization operation in accordance with this invention.

Table I sets forth the compositions of preferred $C_5$–$C_6$ isomerizable hydrocarbon-containing feedstocks useful in the plural stage operation of this invention:

TABLE I

| | FEEDSTOCK | | |
|---|---|---|---|
| | A | B | C |
| Gravity, °API | 82.4 | 82.7 | — |
| Sulfur RN, ppm | 4.3 | 3.6 | — |
| Bromine Index | 29 | 100 | 192 |
| Component Analysis, Wt. % | | | |
| Iso-Butane (i-$C_4$) and Ltr. | .4 | 0.9 | 0.6 |
| Normal Butane (n-$C_4$) | 4.9 | 5.3 | 4.9 |
| Iso-Pentane (i-$C_5$) | 15.1 | 15.4 | 17.6 |
| Normal Pentane (n-$C_5$) | 20.4 | 17.9 | 19.2 |
| 2,2-Dimethylbutane (2,2-DMB) | 1.1 | 1.3 | 1.3 |
| Cyclopentane (CP) | 1.6 | 1.5 | 1.5 |
| 2,3-Dimethylbutane (2,3-DMB) | 2.5 | 1.6 | 3.0 |
| 2-Methyl Pentane (2-MP) | 13.2 | 15.1 | 14.2 |
| 3-Methyl Pentane (3-MP) | 7.8 | 8.2 | 8.2 |
| Normal Hexane (nHx) | 19.6 | 17.2 | 16.2 |
| Methylcyclopentane (MCP) | 5.8 | 6.1 | 5.1 |
| Cyclohexane (CHx) | 2.7 | 2.7 | 2.0 |
| Benzene (Bz) | 2.7 | 3.9 | 3.7 |
| Heptanes & Heavier ($C_7$+) | 2.2 | 2.9 | 2.5 |
| Total | 100.0 | 100.0 | 100.0 |
| Research Octane Number | | | |
| Clear | 72.0 | 74.0 | 78.0 |
| +3cc Tetraethyllead RON(+3) | 90.2 | 91.6 | 90.0 |
| Motor Octane Number | | | |
| Clear | 69.5 | 72.0 | 74.0 |
| +3cc Tetraethyllead MON(+3) | 90.5 | 92.0 | 89.8 |
| ASTM Distillation | | | |
| IBP | 94 | 107 | |
| 5% | 106 | 109 | |
| 10% | 110 | 111 | |
| 20% | 115 | 116 | |
| 30% | 120 | 121 | |
| 40% | 124 | 126 | |
| 50% | 130 | 130 | |
| 60% | 136 | 136 | |
| 70% | 142 | 142 | |
| 80% | 149 | 148 | |
| 90% | 157 | 156 | |
| 95% | 162 | 162 | |
| EP | 196 | 186 | |
| Recovered | 98 | 98 | |
| Residue | 1 | 1 | |

By the following the practices of this invention employing a $C_5$–$C_6$ hydrocarbon stream containing isomerizable hydrocarbons including n-pentane and n-hexane, there is recovered from the last stage of the plural stage isomerization operation an isomerate product having a higher iso-$C_5$/n-$C_5$ ratio as compared with the hydrocarbon feed supplied to the first stage of the isomerization operation as well as an isomerate having a higher 2,2-dimethylbutane (2,2-DMB) content and a higher methylcyclopentane (MCP)/cyclohexane (CHx) ratio. The improved isomerate is obtained since the operating temperatures of the isomerization units, in sequence, are increased from the first stage to the last stage to compensate for declining catalyst activity from the first stage to the last stage. These changes in isomerate composition and quality result in an isomerate product having an increased octane value.

The data presented in accompanying Table II illustrate the advantages of the practices of this invention.

TABLE II

| Period | 1 | 2 | 3 | 4 | 5 |
|---|---|---|---|---|---|
| Hours | 17 | 1512 | 3849 | 4210 | 4310 |
| Reactor Inlet Temp. °F. | 303 | 305 | 303 | 320 | 342 |
| Reactor Outlet Temp. °F. | 331 | 325 | 309 | 340 | 367 |
| Liquid Hourly Space Velocity | 2.0 | 2.0 | 2.0 | 2.0 | 2.0 |
| Total Liquid Products | | | | | |
| $iC_5/nC_5$ ratio | 2.9 | 1.99 | 1.23 | 1.71 | 1.91 |
| 2,2-DMB, wt. % | 10.10 | 7.90 | 5.50 | 6.05 | 6.80 |
| MCP/CHx ratio | 1.47 | 1.46 | 1.33 | 1.74 | 1.93 |
| RON,* + 3cc TEL | 97.6 | 96.8 | 95.9 | 95.9 | 96.7 |
| MON,** + 3cc TEL | 100.4 | 100.0 | 97.5 | 97.8 | 99.2 |

*RON - Research Octane Number
**MON - Motor Octane Number

The data presented in accompanying Table II were obtained by employing an in-situ prepared isomerization catalyst useful in the practices of this invention, i.e. an isomerization catalyst made up of an in-situ chlorinated 0.6% by weight platinum on eta-alumina. Also, the data presented in Table II were obtained from $C_5$–$C_6$ feedstocks described hereinabove, such as Feedstock B of Table I, under isomerizing conditions during which all conditions were the same except for temperature.

As indicated in Table II the product quality data for periods 1, 2 and 3 which were obtained at a fairly constant inlet temperature of about 303°–305°F. show a gradual decline in catalyst activity as evidenced by a decrease in isopentane/n-pentane ($iC_5/nC_5$ ratio), 2,2-dimethylbutane (2,2-DMB) content and methylcyclopentane/cyclohexane (MCP/CHx) ratio. During periods 4 and 5 inlet temperatures of 320° and 342°F. and maximum outlet temperatures of 340° and 367°F., respectively, were employed. The product quality data obtained show that higher $iC_5/nC_5$ ratios, 2,2-DMB contents MCP/CHx ratios and octane values or rating were obtained. The MCP/CHx ratios were considerably higher than those in periods 1, 2 and 3 when the catalyst was fresher or more active.

The data of Table II show that the highest octane product can be obtained by operating the first reactor (more active catalyst) or first isomerization unit of a plural stage isomerization unit at a lower temperature to obtain maximum 2,2-DMB and $iC_5$ yields. The last reactor or the second or last isomerization unit of a plural stage isomerization operation in accordance with this invention employs a less active catalyst at a higher temperature in order to obtain maximum MCP yield. The latter, i.e. MCP yield, is important since considerable quantities of MCP, CHx and benzene (Bz) are usually present in the $C_5$–$C_6$ hydrocarbon feed to the isomerization unit, such as an amount in the range about 2–8% by weight, about 1–6% by weight and about 1–7% by weight, respectively, total, in the range about 4–20% by weight. It is usually economically unfeasible to fractionate or separate these compounds from the feedstock. Further, the higher MCP yield aids in obtaining higher octane values.

In the $C_5$–$C_6$ isomerization operations in accordance with this invention the above-indicated advantages are obtained since combined $C_5$–$C_6$ paraffin isomerization is reaction rate limited and not equilibrium limited and the MCP/CHx ratio is equilibrium limited but higher temperatures favor higher MCP/CHx ratios. Accordingly, higher temperatures favor both $C_5$ and $C_6$ paraffin isomerization and MCP/CHx ratio. However, higher temperatures are undesirable when a fresh active isomerization catalyst is employed since cracking would occur. Based on the above and in accordance with the practices of this invention the $C_5$–$C_6$ isomerization of a hydrocarbon stream containing $C_5$–$C_6$ isomerizable hydrocarbons is carried out in a plural stage operation with fresh catalyst and lower temperatures being employed in the first stage and higher temperatures and a relatively depleted or inactive catalyst being employed in the last stage.

In a plural stage isomerization operation in accordance with this invention accordingly, most or a major amount of the $C_5$–$C_6$ isomerization will take place or be achieved in the first stage reactor or isomerization unit. In the last stage reactor or isomerization unit which is operated at a higher temperature some additional $C_5$ and $C_6$ isomerization takes place but the largest effect would be increased MCP/CHx ratio in the resulting isomerate. As indicated hereinabove the last stage reactor of the isomerization unit can be operated at a higher temperature, substantially higher than the first stage reactor since the catalyst employed in the last stage is partially deactivated and would not promote cracking as readily as a fresh catalyst, such as the first stage catalyst. Since the effects of increased $C_5$ isomerization to $iC_5$ and $C_6$ isomerization to 2,2-DMB and CHx to MCP are all in the direction of higher octanes, a plural stage isomerization operation in accordance with this invention is beneficial.

As will be apparent to those skilled in the art in the light of the foregoing disclosure, many modifications, alterations and substitutions are possible in the practice of this invention without departing from the spirit or scope thereof.

I claim:

1. A process for isomerizing a hydrocarbon fraction having a boiling point range in the range from about 90° to about 210°F. and containing $C_5$ and $C_6$ isomerizable hydrocarbons which comprises subjecting said hydrocarbon fraction to a plural stage vapor phase catalytic isomerization operation, wherein the catalyst employed in each stage of said plural stage catalytic isomerization operation is chlorinated platinum-containing alumina catalyst, wherein the activity of the catalyst employed in the first stage of said plural stage isomerization operation is greater than the activity of the catalyst employed in the final stage of said plural stage isomerization operation, wherein said catalyst employed in said first stage is fresh or regenerated catalyst to obtain maximum 2,2-dimethylbutane and isopentane yields, wherein said catalyst in said final stage, after service as a first stage catalyst, is employed to obtain in said final stage maximum methylcyclopentane yield, the first stage of said isomerization operation being carried out under conditions such that the hydrocarbon fraction is supplied to said first stage at a temperature in the range about 300°–305°F. and recovered from said first stage at a temperature in the range 310°–335°F. and wherein the hydrocarbon fraction undergoing plural stage isomerization is supplied to the last stage of said plural stage isomerization operation at a temperature in the range about 315°–350°F. and recovered from said last stage at a temperature in the range about 340°–370°F., in the aforesaid vapor phase catalytic isomerization operation the hydrocarbon fraction undergoing isomerization being supplied sequentially and serially from the first stage of the plural stage isomerization operation through to the last stage of said isomerization operation.

2. A process in accordance with claim 1 wherein said hydrocarbon fraction contains a minor amount by weight of n-pentane and n-hexane.

3. A process in accordance with claim 1 wherein each of the stages of said plural stage vapor phase catalytic isomerization operation is carried out at a pressure in the range 450–550 psig.

4. A process in accordance with claim 1 wherein each of the stages of said plural stage vapor phase catalytic isomerization operation is carried out in the presence of gaseous hydrogen.

5. A process in accordance with claim 4 wherein the hydrogen to hydrocarbon mol ratio is about 1.25.

6. A process in accordance with claim 1 wherein the temperature differential between the temperature of the hydrocarbon fraction supplied to said first stage and the temperature of the hydrocarbon fraction supplied to said last stage is in the range from about 10° to about 50°F.

7. A process in accordance with claim 1 wherein the temperature differential between the temperature of the hydrocarbon fraction recovered from said first stage and the temperature of the hydrocarbon fraction recovered from the last stage is in the range from about 5° to about 60°F.

8. A process in accordance with claim 1 wherein said plural stage isomerization operation is a two stage isomerization operation.

9. A process in accordance with claim 1 wherein upon depletion of the activity of the catalyst employed in said last stage said last stage is removed from said isomerization operation, the immediately preceding stage of the isomerization operation becomes the last stage and a new stage containing fresh catalyst is employed as said first stage.

10. A process in accordance with claim 1 wherein each of the stages of said isomerization operation is operated adiabatically.

11. A process in accordance with claim 1 wherein said plural stage isomerization operation is a substantially isobaric isomerization operation.

12. A process in accordance with claim 1 wherein the stages making up said plural stage isomerization operation number in the range 2–4.

13. A process in accordance with claim 1 wherein each of the stages of said plural stage isomerization operation is supplied with the hydrocarbon fraction undergoing isomerization at a liquid hourly space velocity in the range of about 1–2.

14. A process in accordance with claim 1 wherein said hydrocarbon fraction contains n-pentane and n-hexane in an amount in the range about 15–25% by weight.

15. A process in accordance with claim 1 wherein said hydrocarbon fraction contains about 8–15% by weight benzene, cyclohexane and methylcyclopentane.

16. A process in accordance with claim 1 wherein the catalyst employed in each of the stages of said plural stage isomerization operation is an in-situ chlorinated platinum-eta-alumina catalyst.

17. A process in accordance with claim 1 wherein said catalyst has a platinum content of about 0.6% by weight.

* * * * *